United States Patent [19]

Meyer

[11] Patent Number: 4,577,578

[45] Date of Patent: Mar. 25, 1986

[54] METHOD FOR TRANSPORTING GOODS BY FREIGHTER FROM AN ARCTIC PORT TO AN ICE-FREE PORT, AND FREIGHTER FOR THAT PURPOSE

[75] Inventor: Hans Meyer, Ratingen, Fed. Rep. of Germany

[73] Assignee: Ruhrgas LNG Flussigerdgas Service GmbH, Essen, Fed. Rep. of Germany

[21] Appl. No.: 570,232

[22] Filed: Jan. 12, 1984

[30] Foreign Application Priority Data

Jan. 13, 1983 [DE] Fed. Rep. of Germany ..... 3300894
Jan. 13, 1983 [DE] Fed. Rep. of Germany ..... 3300898

[51] Int. Cl.[4] ..... B63B 21/00
[52] U.S. Cl. ..... 114/248; 114/249
[58] Field of Search ..... 114/40–42, 114/72, 268, 258–260, 248–252

[56] References Cited

U.S. PATENT DOCUMENTS

| | | | |
|---|---|---|---|
| 1,005,236 | 10/1911 | Larr | 114/248 |
| 3,362,372 | 1/1968 | Peterson | 114/248 |
| 3,485,200 | 12/1969 | Iozza | 114/248 |
| 3,698,349 | 10/1972 | Stevens | 114/248 |
| 3,934,529 | 1/1976 | Gallagher | 114/40 |
| 4,083,317 | 4/1978 | Chaney | 114/40 |
| 4,395,178 | 7/1983 | MacDonell | 114/259 |
| 4,465,012 | 8/1984 | Bos | 114/259 |

*Primary Examiner*—S. D. Basinger
*Assistant Examiner*—C. T. Bartz
*Attorney, Agent, or Firm*—Beall Law Offices

[57] ABSTRACT

A method for transporting goods by freighter over a route from an arctic port to an ice-free port, using ice-breaking freighters, the route including an ice-edge, the method characterized in that the ice-breaking freighters are used only for the route run between the arctic port and the ice-edge, the location of which varies according to the time of the year and wherein ice-strengthened freighters are used for the route run between the ice-edge and the ice-free port, the goods being trans-shipped, in the ice-edge area, at sea, from the ice-breaking freighters directly to the ice-strengthened freighters. Also disclosed is a ship, more particularly an ice-breaking freighter, adapted to be coupled in tandem to at least one other ship, the freighter comprising a substantially spherical convex surface constituting the stern thereof and a bow comprising a substantially vertically disposed concave channel having a substantially arcuate cross-section, the radius thereof corresponding to that of the spherical surface, thus making it possible for the bow of the freighter to be cooperatively coupled flexibly to the stern of a further ship, having the spherical convex surfaced stern or the stern of the freighter to be cooperatively coupled flexibly to the bow of a further ship having a bow compressing the concave channel.

12 Claims, 7 Drawing Figures

METHOD FOR TRANSPORTING GOODS BY FREIGHTER FROM AN ARCTIC PORT TO AN ICE-FREE PORT, AND FREIGHTER FOR THAT PURPOSE

The present invention relates to a freighter system, more particularly to a method for transporting goods by freighter from an arctic port to an ice-free port, using ice-breaking freighters.

If consideration is given to the route between the Canadian arctic and the ice-free ports of North America and Europe, it will be seen that, under severe ice conditions, between 30 and 40%, and under mild ice conditions, between 5 and 10%, of the distance is ice covered. In the middle of the year, the figure is about 30%, half of which can still be handled with ice-strengthened ships. In the middle of the year, therefore, ice breakers are needed for only 10 to 15% of the entire route.

Existing operations for transporting goods by freighter from an arctic to an ice-free port include ice-breaking freighters for the entire route. As a result, the economics of the operations leaves much to be desired. The structural strength and propelling power of the ships involved, must withstand ice between 2 and 3 m in thickness, resulting respectively in high capital and operating costs. In addition to this, the design of the ships must compromise between ice breaking and sailing in open waters especially in heavy seas. It is impractical to provide an optimal design for both conditions.

According to the present invention, in transporting goods by freighter from an arctic port to an ice-free port, ice-breaking freighters are used only for the route between the arctic port and the edge of the ice, the location of which varies according to the time of year, while ice-strengthened freighters are used for the route between this edge of the ice area and the ice-free port, the goods being transshipped in the said area, at sea, from the ice-breaking freighters to the ice-strengthened freighters.

The present invention thus makes it possible to optimize the ice-breaking properties of ice-breaking freighters and the sailing properties of ice-strengthened freighters in open waters. Transshipment of the goods takes place in the vicinity of the ice-edge where no swell is expected to interfere and thus the operation can be carried out safely. The location of the ice-edge naturally varies according to the time of the year. Rapid determination of the location of the transshipment will, of course, ensure that the ships are operated only under the conditions for which they have been designed.

It is desirable for at least two ice-breaking freighters at a time to make the run between the arctic port and the location of the ice-edge, which as stated above, varies according to the season. The ice-breakers operate in tandem, the first ship opening the channel and thus assisting the passage of the second ship which therefore uses correspondingly less power. It is quite possible for the channel behind the first ship to be practically free of ice, in which case the second ship uses only about 5% of the propelling power of the first ship. Apart from this, tandem operation increases the reliability and safety of the operation. If necessary, the first ship may take the second ship in tow. The ships may also change places at any time. Since the ships can provie support for each other, the risk of damage is reduced.

The ice-breaking freighters are preferably coupled together in direct contact with each other when making the run between the arctic port and the ice edge, the location of which as stated above, varies according to the time of year. This facilitates the progress of the second ship since it no longer has to maintain its distance from the first ship or concern about straying from the ice-free channel. In case of necessity, one ship may also push the other.

According to the present invention, an ice-strengthened freighter may be loaded, during transshipment, simultaneously from at least two correspondingly smaller ice-breaking freighters. In this case, the ice-breaking freighters are preferably moored on each side of the ice-strengthened freighter, but they may also be moored side by side, or one behind the other, on one side thereof. In any case, fenders are used to prevent damage to the ships. Each of the ships are fitted with active maneuvering devices, such as lateral thrust units.

According to the present invention, at least two ice-breaking freighters may be loaded simultaneously in the arctic port. In this case, the freighters are preferably located side by side or one behind the other and use their own loading equipment.

Simultaneous loading and transshipment of ice-breaking freighters ensures that tandem operation is not outweighed by transshipment times.

The method according to the invention offers particular advantage when used in connection with the shipping of liquified natural gas (LNG).

It is to be borne in mind that the concept of the invention, in addition to providing savings in shipping costs, greatly facilitates development. On the one hand, the power demand is within normal limits and, on the other hand, since there is little difference in size between the ice-breaking freighter-tanker and tested ice-breakers, proven results are available and can therefore be utilized at an earlier stage. Finally, smaller ice-breaking freighter-tankers allow a larger model-scale in the ice channel, thus increasing the accuracy of results.

The tandem operation according to the present invention eliminates the need for the extremely wide auxiliary ice-breakers which would otherwise be needed for LNG ice-breakers. Smaller ice-breaking freighter-tankers also possess increased operating reliability, since they may be equipped with smaller loading tanks.

If one of the ice-breaking freighter-tankers becomes unserviceable, the remaining freighter-tanker can provide between 60 and 70% of the annual output by using scheduled reserves. If one of the large ice-strengthened freighter-tankers becomes unserviceable, a normal LNG tanker may be used, transshipment accordingly taking place nearer the edge of the ice-covered zone.

The present invention furthermore provides a ship which can be conveniently coupled to at least one further like ship. The ship being an ice-breaking freighter, it is particularly suited for implementing the method according to the invention. The present ice-breaking freighter is characterized by having a convex, substantially spherical-shaped stern and a bow comprising a generally vertically disposed concave channel, having a substantially arcuate cross-section, the radius of which corresponds to that of the said spherical shaped stern. Thus, such ship may be flexibly coupled to a similar ship—bow to stern—in direct contact one to another, affording close tandem operation, the contacting surfaces permitting relative movement between the ships. Such arrangement provides particularly favourable conditions in that the center of the spherical surface of the stern is in the vicinity of the center of buoyance of the freighter.

According to the invention, it is possible, in order to reduce friction and wear, for the spherical surface of the stern to carry rollers having horizontally disposed axes, while the channel at the bow carries rollers having vertically disposed axes.

In order that closely arranged rollers shall not cause a reduction in strength, the rollers having said horizontal axes and those having said vertical axes may be staggered in relation to each other.

According to the invention, the peripheral surfaces of the rollers may be adapted to the contours of the relevant bow and stern surfaces.

The freighter according to the invention may furthermore comprise tensioning devices arranged at the bow and/or the stern, the preloading force thereof being adjustable. This allows the two freighters to be retained together resiliently. Each tensioning device may comprise means for automatically coupling to a further ice-breaking freighter.

According to another advantageous characteristic, measuring devices are arranged on the spherical surface at the stern and/or the channel at the bow, for the purpose of adjusting the preloading force to be applied by the tensioning devices while the ships are sailing coupled together. On the one hand, this ensures the necessary firm connection and, on the other hand, any overloading is prevented.

Since vessel coupling procedure is an extremely difficult maneuver, assistance in this connection is provided in the form of equipment for measuring and controlling distance, speed, angle or rotation, depth and direction, accordingly providing automatic coupling to another ice-breaking freighter. These measuring and controlling devices may comprise radio direction-finding units. Such provides very satisfactory control of the two freighters which are to be coupled together.

It is desirable for the propelling and maneuvering units of the one freighter to be capable of being connected to that of the other freighter, in order to provide joint control. This permits two freighters coupled together to be maneuvered as a single unit.

The freighter according to the invention may also comprise a device for the reception and combustion of "boil-off" from at least one coupled ice-breaking freighter in its own power-plant. Thus when two ice-breaking tankers operate with only one power plant, gas losses can still be avoided.

In one aspect of the present invention there is provided a method for transporting goods by freighter over a route from an arctic port to a ice-free port, using ice-breaking freighters, the route including an ice-edge, the method characterized in that the ice-breaking freighters are used only for the route run between the arctic port and the ice-edge, the location of which varies according to the time of the year, and wherein ice-strengthened freighters are used for the route run between the ice-edge and the ice-free port, the said goods being transshipped, in the said ice-edge area, at sea, from the ice-breaking freighters directly to the ice-strengthened freighters.

In a further aspect of the present invention there is provided a ship, more particularly an ice-breaking freighter adapted to be coupled in tandem to at least one other ship, the freighter comprising a substantially spherical convex surface constituting the stern thereof and a bow comprising a substantially vertically disposed concave channel having a substantially arcuate cross-section, the radius thereof corresponding to that of the said spherical surface, thus making it possible for the bow of the freighter to be cooperatively coupled flexibly to the stern of a further ship, having said spherical convex surfaced stern or the stern of the freighter to be cooperatively coupled flexibly to the bow of a further ship having a bow comprising said concave channel.

The invention is illustrated by way of example in the accompanying drawings wherein.

Figure 1:
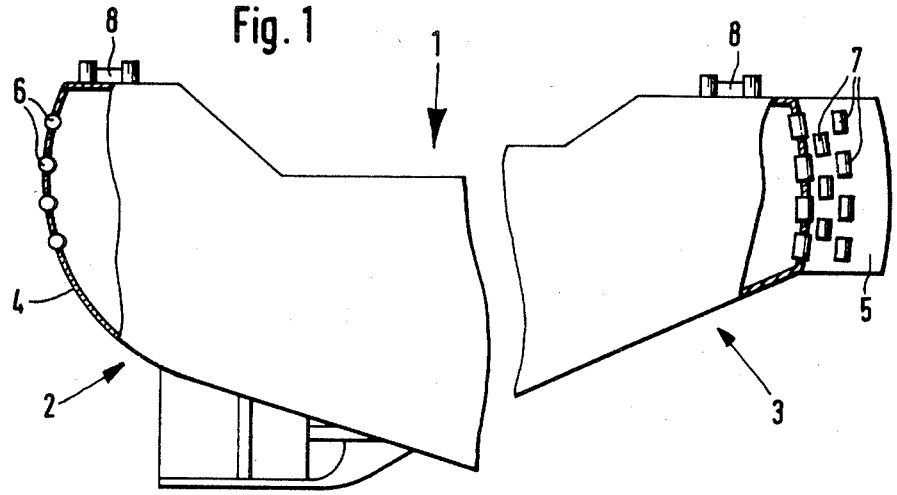
FIG. 1 shows diagrammatical cross-sections of the stern to the left and of the bow to the right, of an ice-breaking freighter in accordance with the present invention.
Figure 2:
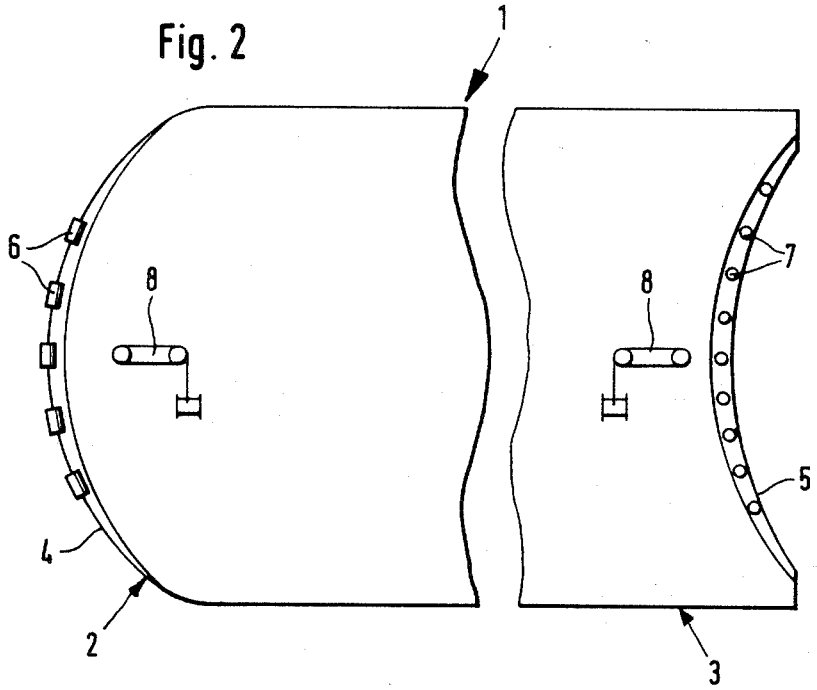
FIG. 2 is a diagrammatical plan view of the arrangement according to FIG. 1.

FIGS. 1 and 2 show the stern 2 to the left and the bow 3 to the right, of an ice-breaking freighter 1. The stern has a convex spherical surface 4, the center of which is located in the vicinity of the center of buoyancy of the freighter. Located at the bow is a substantially vertical concave channel 5 of part-cylindrical cross-section, the radius thereof corresponding to that of spherical surface 4. As may be seen in FIG. 1, channel 5 is curved convexly in the vertical direction, the center of the convex curve being also located in the vicinity of the center of buoyancy of the vessel.

Spherical surface 4 of stern 2 is equipped with rollers 6 having horizontally disposed axes, while channel 5 at bow 3 is equipped with rollers having vertically disposed axes.

Figure 3:
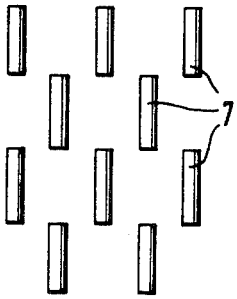
FIG. 3 is a front elevation of the arrangement of the bow rollers.
Figure 4:
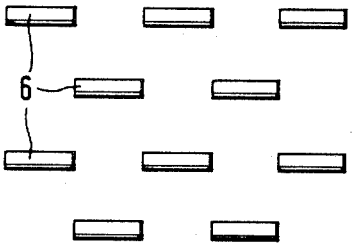
FIG. 4 is a front elevation of the arrangement of the stern rollers.
Figure 5:
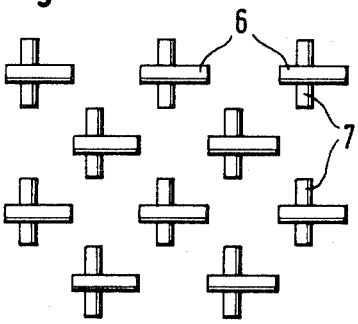
FIG. 5 shows the stern and bow roller arrangements superimposed one on another.

As may be seen from FIGS. 3 and 4 both rollers 6 and rollers 7 are staggered in relation to each other. FIG. 5 shows the two roller arrangement superimposed, as occurs when two ice-breaking freighters are coupled together bow to stern.

The contours of rollers 6 match spherical surface 4, while the contours of rollers 7 are adapted to channel 5.

Tensioning devices 8 are arranged adjacent stern 2 and bow 3 and are used to couple two freighters together, for which end they are provided with automatic couplings. The preloading force is adjustable by means of measuring devices, (not shown), which are arranged on spherical surface 4 and in channel 5.

The ice-breaking freighters may be tankers of the order of 260 m in length. Coupling two such ships together is a difficult maneuver. For the purpose of facilitating this maneuver, freighter 1 is provided with equipment (not shown) for measuring and controlling distance, speed, angle of rotation, depth and direction. This equipment may comprise radio direction finding units or other suitable equipment well known to those skilled in the art to which the present invention is directed.

Means are also provided to connect the propelling and maneuvering equipment of freighter 1 to that of another ice-breaking freighter for joint control such also being familiar to those skilled in the art to which the invention is directed.

Finally, it is also possible to burn the "boil-off" from the coupled freighter in the power plant of freighter 1.

Figure 6:
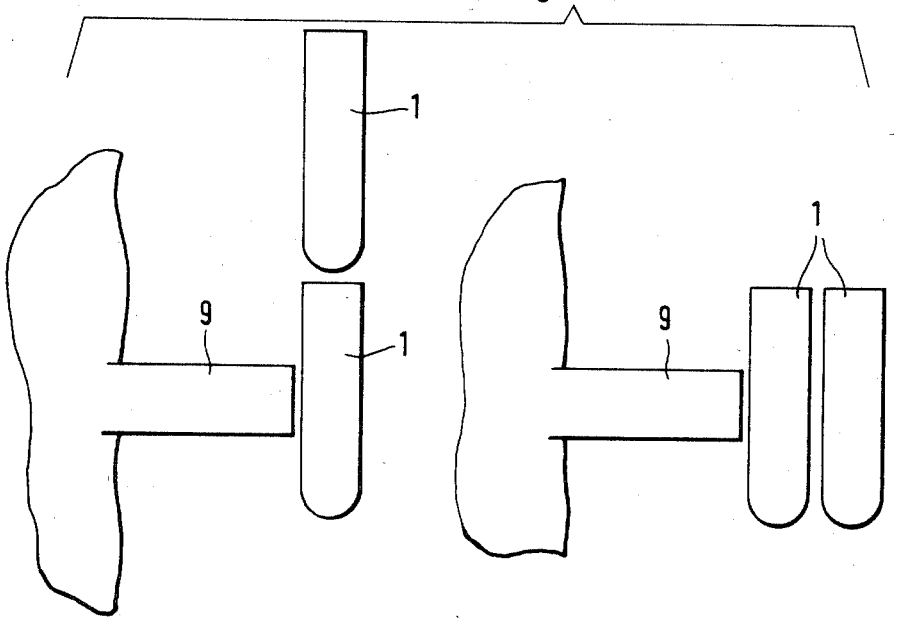
FIG. 6 is a diagrammatical view of two possible arrangements for the simultaneous loading of two ice-breaking freighters.

FIG. 6 illustrates simultaneous loading of two ice-breaking freighters 1 by means of a bridge-crane 9 in an artic port. One of the freighters is moored at the bridge-crane and communicates with the other freighter through its own loading equipment. At the left of FIG. 6, the freighters are moored one behind the other; at the right they are are moored side by side.

Figure 7:
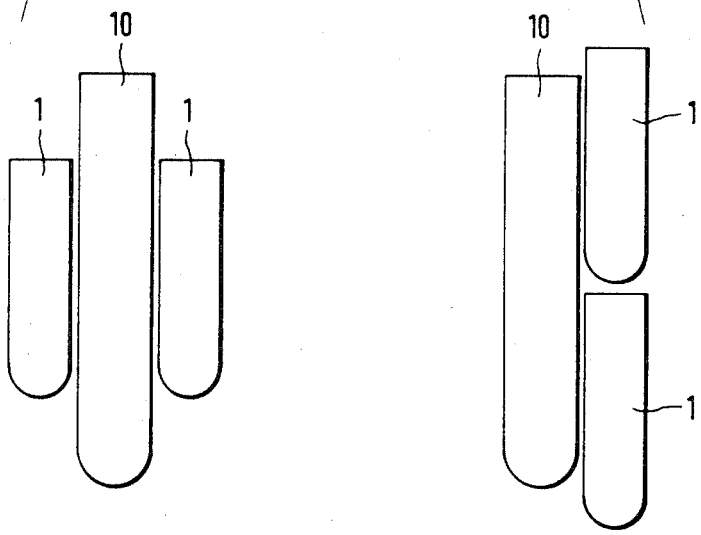
FIG. 7 is a diagrammatical view of two possible arrangements for the simultaneous transshipment of goods from two ice-breaking freighters to one ice-strengthened freighter.

FIG. 7 illustrated simultaneous transshipment of goods from two ice-breaking freighters to a larger ice-strengthened freighter 10, transshipment taking place at the edge of the ice-covered water where there is little swell. Here again, on-board loading equipment is used. At the left of FIG. 7, loading is carried out on both sides of freighter 10; at the right, on one side of freighter 10. In the latter case, freighters 1 may be moored side by side instead of one behind the other.

I claim:

1. An ice-breaking freighter adapted to be coupled in tandem to at least one other ice-breaking freighter, said freighter comprising:

a stern of substantially spherical convex surface, and a bow having a substantially vertically disposed channel of convex vertical cross-section and concave horizontal cross-section, said stern and said bow shaped to cooperatively couple with the bow or stern, respectively, of a like freighter to allow relative movement of coupled like freighters.

2. A freighter according to claim 1 further comprising tensioning devices on said bow and said stern, said tensioning device controlling the preloading force with which said bow and said stern of mated like freighters are coupled.

3. The ice-breaking freighter of claim 1 wherein said stern is equipped with rollers having horizontally disposed axes and said bow is equipped with rollers having vertically disposed axes, said stern mounted horizontally disposed rollers of one freighter engaging the bow mounted vertically disposed rollers of another freighter when said freighters are cooperatively coupled stern to bow.

4. A freighter according to claim 1, characterized in that the center of said spherical surface of said stern is located at the center of buoyancy of said freighter.

5. A freighter according to claim 4, characterized in that the center of the convex curve of said bow is located at the center of buoyancy of said freighter.

6. A freighter according to claim 3 wherein said stern rollers and said bow rollers are provided in a plurality of horizontal rows of a plurality of said rollers, rollers in adjacent horizontal rows on either said bow or said stern staggered vertically from one another, said bow rollers and said stern rollers staggered equally in order to properly mate when like freighters are coupled.

7. An ice-breaking freighter adapted to be coupled in tandem to at least one other ice-breaking freighter, said freighter comprising:

a stern of substantially spherical convex surface, and a bow having a substantially vertically disposed channel of convex vertical cross-section and concave horizontal cross-section, said stern and said bow shaped to cooperatively couple with the bow or stern, respectively, of a like freighter to allow relative vertical movement of said coupled like freighters, relative rotational movement of said coupled like freighters about a vertical axis perpendicular to the deck of said freighter, relative rotational movement of said coupled like freighters about a first horizontal axis parallel to and in the same vertical plane as the longitudinal center line of said freighter, and relative rotational movement of said coupled like freighters about a second horizontal axis perpendicular to said first horizontal axis.

8. The ice-breaking freighter of claim 7 wherein said stern is equipped with rollers having horizontally disposed axes and said bow is equipped with rollers having vertically disposed axes, said stern mounted horizontally disposed rollers of one freighter engaging the bow mounted vertically disposed rollers of another freighter when said freighters are cooperatively coupled stern to bow.

9. A freighter according to claim 7, characterized in that the center of said spherical surface of said stern is located at the center of buoyancy of said freighter.

10. A freighter according to claim 9, characterized in that the center of the convex curve of said bow is located at the center of buoyancy of said freighter.

11. A freighter according to claim 7 further comprising tensioning devices on said bow and said stern, said tensioning devices controlling the preloading force with which said bow and said stern of mated like freighters are coupled.

12. A freighter according to claim 8 wherein said stern rollers and said bow rollers are provided in a plurality of horizontal rows of a plurality of said rollers, rollers in adjacent horizontal rows on either said bow or said stern staggered vertically from one another, said bow rollers and said stern rollers staggered equally in order to properly mate when like freighters are coupled.

* * * * *